US009195190B2

(12) United States Patent
Honke et al.

(10) Patent No.: US 9,195,190 B2
(45) Date of Patent: Nov. 24, 2015

(54) FIXING APPARATUS AND FILM FOR USE IN FIXING APPARATUS

(71) Applicant: CANON KABUSHIKI KAISHA, Tokyo (JP)

(72) Inventors: Takashi Honke, Mishima (JP); Satoru Taniguchi, Mishima (JP); Hirohiko Aiba, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/719,816

(22) Filed: Dec. 19, 2012

(65) Prior Publication Data

US 2013/0164060 A1 Jun. 27, 2013

(30) Foreign Application Priority Data

Dec. 21, 2011 (JP) ..... 2011-280103

(51) Int. Cl.
*G03G 15/20* (2006.01)

(52) U.S. Cl.
CPC .... *G03G 15/2057* (2013.01); *G03G 2215/2035* (2013.01)

(58) Field of Classification Search
CPC ..... G03G 15/2057; G03G 2215/2035
USPC ..... 399/333, 329
See application file for complete search history.

(56) References Cited

U.S. PATENT DOCUMENTS

2011/0082260 A1* 4/2011 Omata et al. ..... 525/276

FOREIGN PATENT DOCUMENTS

| | | | |
|---|---|---|---|
| CN | 1324007 | A | 11/2001 |
| CN | 101017354 | A | 8/2007 |
| JP | 8-328407 | A | 12/1996 |
| JP | 9-080946 | A | 3/1997 |
| JP | H09-146391 | A | 6/1997 |
| JP | 2000-321901 | A | 11/2000 |
| JP | 2001-301083 | A | 10/2001 |
| JP | 3397548 | B2 | 4/2003 |
| JP | 2006-126805 | A | 5/2006 |
| JP | 2009-229550 | A | 10/2009 |

* cited by examiner

*Primary Examiner* — David Bolduc
*Assistant Examiner* — Barnabas Fekete
(74) *Attorney, Agent, or Firm* — Canon USA Inc. IP Division

(57) ABSTRACT

A fixing apparatus for fixing a toner image on a recording material, while conveying the recording material bearing the toner image, at a nip portion includes a tubular film, a heater configured to heat the film, and a pressure member configured to form the nip portion with the film, wherein the film has a property that a resistance value per unit area between an outer surface of the film and an inner surface of the film becomes $5\times10^{11}$ ($\Omega\cdot cm^2$) or more when a voltage of 500 V or less is applied between the outer surface and the inner surface, and a resistance value per unit area between the outer surface and the inner surface becomes $5\times10^{9}$ ($\Omega\cdot cm^2$) or less when a voltage of 1000 V or more is applied between the outer surface and the inner surface.

37 Claims, 8 Drawing Sheets

FIXING APPARATUS AND FILM FOR USE IN FIXING APPARATUS

BACKGROUND OF THE INVENTION

1. Field of the Invention

The present invention relates to a fixing apparatus used for an image forming apparatus such as an electrophotographic printer and a copying machine, and a film for use in the fixing apparatus.

2. Description of the Related Art

Fixing apparatuses including a film heating system are available as a fixing apparatus used for an image forming apparatus including an electrophotographic system.

The fixing apparatus including the film heating system includes a tubular film with high heat resistance, a ceramic heater (hereinafter described as a heater) in contact with an inner surface of a film, and a pressure roller that forms a nip portion with the heater via the film. The fixing apparatus fixes a toner image on a recording material, while conveying the recording material bearing the toner image, at the nip portion. The heater and the film for use in the fixing apparatus including the film heating system have a low thermal capacity, and thus have an advantage that an electric power can be saved and a waiting time can be shortened (a quick start can be realized).

In the above fixing apparatus, when a high resistance fluorine resin layer is used as a surface layer of the pressure roller in order to prevent a paper dust and a toner from adhering to the surface of the pressure roller, the pressure roller is sometimes charged with a charge having the same polarity as that of the toner by sliding friction with the recording material. As a result, there has been a problem that an offset (hereinafter described as an overall offset) occurs in which an unfixed toner borne by the recording material is peeled off by an electrostatic force, adheres onto the film at the nip portion, and appears as an image on a subsequent round.

As a countermeasure to the overall offset, a technique in which a voltage having the same polarity as that of the toner is applied to the film to form an electric field in a direction where the toner is adsorbed to a recording material has been discussed in Japanese Patent Application Laid-Open No. 9-80946.

There is another problem as a separating offset in addition to the aforementioned overall offset. The separating offset occurs when a film surface is strongly charged locally with a charge having a polarity reverse to that of the toner by a separating discharge generated when a trailing edge of the recording material passes through the nip portion, thereby forming an offset electric field when the charged area faces the recording material.

As a countermeasure to this separating offset, a technique in which a resistance value of a fixing member (film) is lowered to reduce the charge has been discussed in Japanese Patent No. 3397548.

To practice the countermeasure to the overall offset in Japanese Patent Application Laid-Open No. 9-80946, it is necessary to increase the resistance value per unit area between an outer surface and an inner surface of the film so as to make a current harder to flow in the film and keep a surface potential on the film when the voltage is applied to the surface of the film to have a potential having the same polarity as that of the toner. However, although the overall offset can be prevented when the resistance value of the film is increased, the separating offset becomes worse because the separating charge on the film formed when the recording material is separated does not sufficiently attenuate.

Meanwhile, to practice the countermeasure to the separating offset in Japanese Patent No. 3397548, it is necessary to reduce the resistance value of the film so that the charge charged on the outer surface of the film quickly attenuates. However, although the separating offset can be prevented when the resistance value per unit area between the outer surface and the inner surface of the film is reduced, the overall offset becomes worse because the current flows from the film toward the pressure roller by the voltage applied to the film.

As described above, it is difficult to balance the countermeasure to the overall offset with the countermeasure to the separating offset.

SUMMARY OF THE INVENTION

The present invention is directed to a fixing apparatus that can balance a countermeasure to an overall offset with a countermeasure to a separating offset, and a film for use in the fixing apparatus.

According to an aspect of the present invention, a fixing apparatus for fixing a toner image on a recording material, while conveying the recording material bearing the toner image, at a nip portion includes a tubular film, a heater configured to heat the film, and a pressure member configured to form the nip portion with the film, wherein the film has a property that a resistance value per unit area between an outer surface of the film and an inner surface of the film becomes $5\times10^{11}$ ($\Omega\cdot cm^2$) or more when a voltage of 500 V or less is applied between the outer surface and the inner surface, and a resistance value per unit area between the outer surface and the inner surface becomes $5\times10^{9}$ ($\Omega\cdot cm^2$) or less when a voltage of 1000 V or more is applied between the outer surface and the inner surface.

According to another aspect of the present invention, a film for use in a fixing apparatus fixing an toner image on a recording material, wherein the film has a property that a resistance value per unit area between an outer surface of the film and an inner surface of the film becomes $5\times10^{11}$ ($\Omega\cdot cm^2$) or more when a voltage of 500 V or less is applied between the outer surface and the inner surface, and a resistance value per unit area between the outer surface and the inner surface becomes $5\times10^{9}$ ($\Omega\cdot cm^2$) or less when a voltage of 1000 V or more is applied between the outer surface and the inner surface.

According to yet another aspect of the present invention, a film for use in a fixing apparatus fixing a toner image on a recording material includes a base layer formed of a metal, a rubber layer containing a filler, a material of which is at least one of metal silicon, silicon carbide, and zinc oxide, and a release layer formed of a fluorine resin containing a filler having an electric conductivity.

According to yet another aspect of the present invention, a film for use in a fixing apparatus fixing a toner image on a recording material includes a base layer formed of a metal, a rubber layer containing a filler, a material of which is at least one of metal silicon, silicon carbide, and zinc oxide, a release layer formed of a fluorine resin, and an adhesion layer formed of a fluorine resin containing an adhesive ingredient and configured to bond the release layer to the rubber layer, wherein a filler having an electric conductivity is contained in at least one of the release layer and the adhesion layer.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
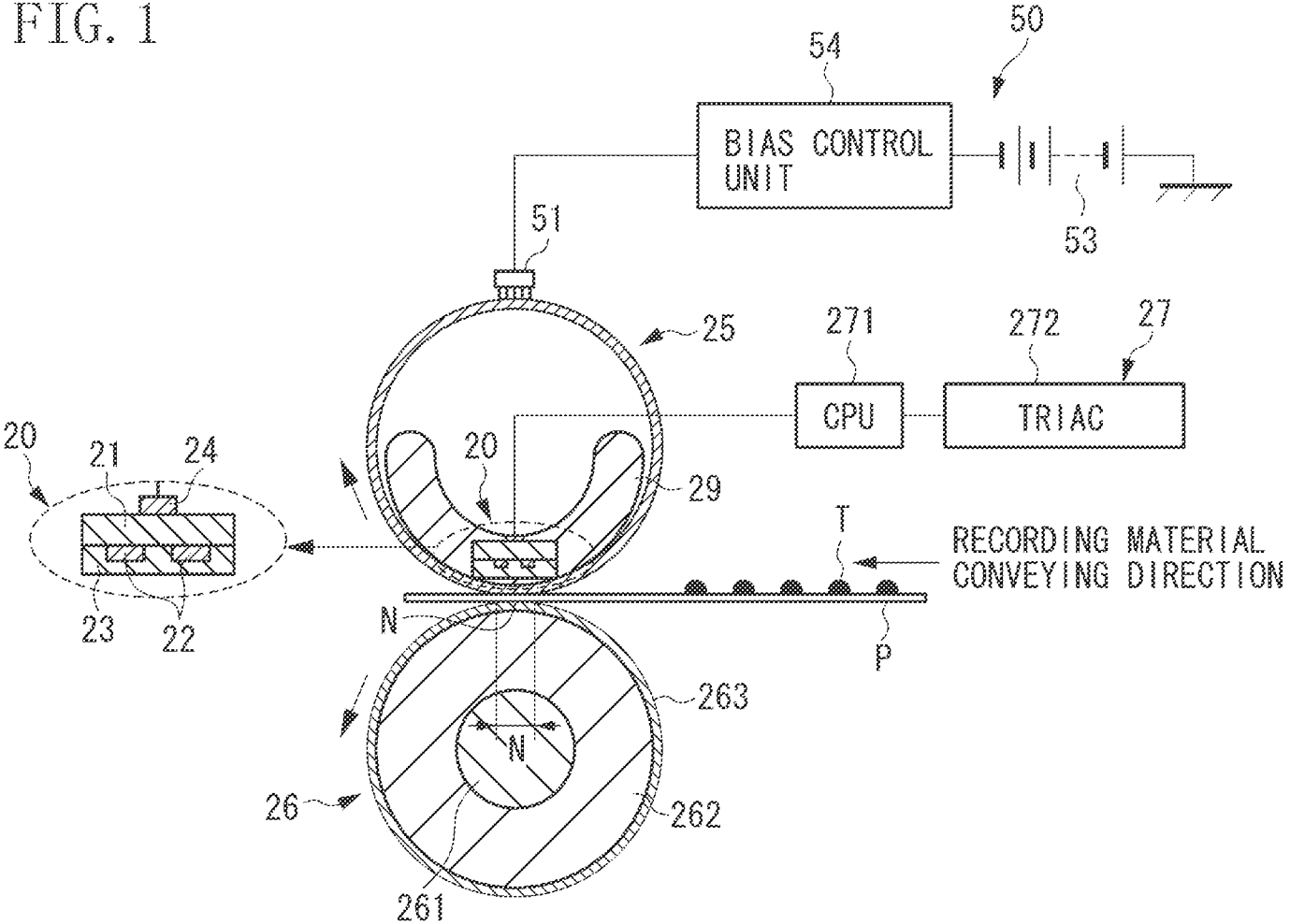
FIG. 1 is a cross-sectional view illustrating a fixing apparatus according to a first exemplary embodiment of the present invention.

FIG. 1 is a cross-sectional view of a fixing apparatus according to a first exemplary embodiment of the present invention. The fixing apparatus in the first exemplary embodiment includes a tubular film 25 with high heat resistance, a ceramic heater 20 as a heater being in contact with an inner surface of the film, and a pressure roller 26 configured to form a nip portion N with the heater 20 via the film 25. The fixing apparatus heats a recording material P and fixes a toner image T on the recording material P, while conveying the recording material P bearing the toner image T, at the nip portion N.

The fixing apparatus in the first exemplary embodiment also includes a voltage applying device 50 for applying the voltage to the film 25 to produce a predetermined potential on a surface of the film 25.

Here, each member that composes the fixing apparatus in the first exemplary embodiment will be described. The ceramic heater includes a slender heat resistant heater board 21 composed of aluminum nitride, alumina, or the like. A resistance element pattern 22 as an exotherm resistance layer that produces a heat by energization is formed along a lengthwise direction on the surface of the heater board 21. Further, the surface of the resistance element pattern 22 is coated with a glass layer 23 as a protection layer. A backside of the heater board 21 (the side opposite to the nip portion N) is provided with a thermistor 24 as a temperature detection member that detects the temperature of the heater 20. A heat resistant resin such as a liquid crystal polymer, polyphenylene sulfide (PPS), and polyether ether ketone (PEEK) is used as a material for a heater holder 29. The heater holder 29 has not only a function as a supporting member that supports the heater 20 but also a function as a guide member that guides a rotation of the film 25.

The pressure roller 26 as a pressure member includes an elastic layer 262 in a circumference of a core shaft 261 and a surface layer 263 in a circumference of the elastic layer 262. An external diameter of the pressure roller 26 is about 30 mm. Metal materials such as aluminum and iron and ceramic porous materials with high strength and low heat capacity having a high adiabatic effect may be used for the core shaft 261. A cored bar formed of solid aluminum is used for the core shaft 261 in the first exemplary embodiment. The elastic layer 262 is a layer having a thickness of 3 mm and composed of a heat resistant silicone rubber, and has the electric conductivity by including a filler such as carbon having the electric conductivity. The surface layer 263 is a tube having a thickness of 10 μm to 50 μm and composed of a fluorine resin such as tetrafluoroethylene perfluoroalkyl vinyl ether copolymer (PFA), polytetrafluoroethylene (PTFE), and tetrafluoroethylene hexafluoropropylene copolymer (FEP).

In the first exemplary embodiment, the material of the surface layer 263 of the pressure roller 26 is a pure fluorine resin (pure PFA tube having a thickness of 30 μm). Therefore, a surface resistance value of the pressure roller 26 in the first exemplary embodiment is $1\times10^{14}$ Ω/cm$^2$, which indicates a high-resistant value. A reason why the high resistance is given to the surface layer 263 is that a phenomenon that a smoothness of the surface reduces and the surface is contaminated with the toner and the paper dust (hereinafter described as "contamination") occurs in some cases when carbon and the like that reduce the resistance is added to the surface layer 263.

Therefore, the surface of the pressure roller is negatively charged (with the same polarity as that of the toner) by the sliding friction against the recording material to form an electric field that weakens the force of holding the unfixed toner to the recording material.

According to the first exemplary embodiment, the potential (negative potential) with the same polarity as that of the toner is given to the surface of the film 25. More specifically, the voltage applying device 50 applies the voltage so that the surface of the film 25 has the potential with a negative polarity. The voltage to be applied to the film 25 is applied to the base layer of stainless (SUS) in the film 25, which is described later and partially exposed on the surface of the film 25, via a power feeding unit 51 such as a conductive brush from a power supply 53. Further, the magnitude of the applied voltage and a timing for applying the voltage are controlled by a voltage control unit 54. In the first exemplary embodiment, the voltage is applied so that the potential on the surface of the film 25 is −400 V when the apparatus is placed in a normal environment (temperature: 23° C. and humidity: 50%). The pressure roller earths the core shaft via the resistance and the voltage is not applied thereto.

In the first exemplary embodiment, an upper limit of the voltage that can be applied to the film 25 is −500 V in order to prevent the overall offset. In particular, the voltage to be applied to the film 25 is necessary to be set to −500 V in an environment such as a low temperature and low humidity (temperature: 10° C. and humidity: 15%), where the pressure roller is easily charged negatively by the sliding friction with the recording material.

The upper limit described above may be less than 500 V.

The film 25, which has a characteristic configuration according to the first exemplary embodiment, will be described. The film 25 is in a tubular shape with a diameter of 30 mm, having flexibility. The film 25 is loosely fitted onto a semi-circular film guide member 29.

Figure 2:
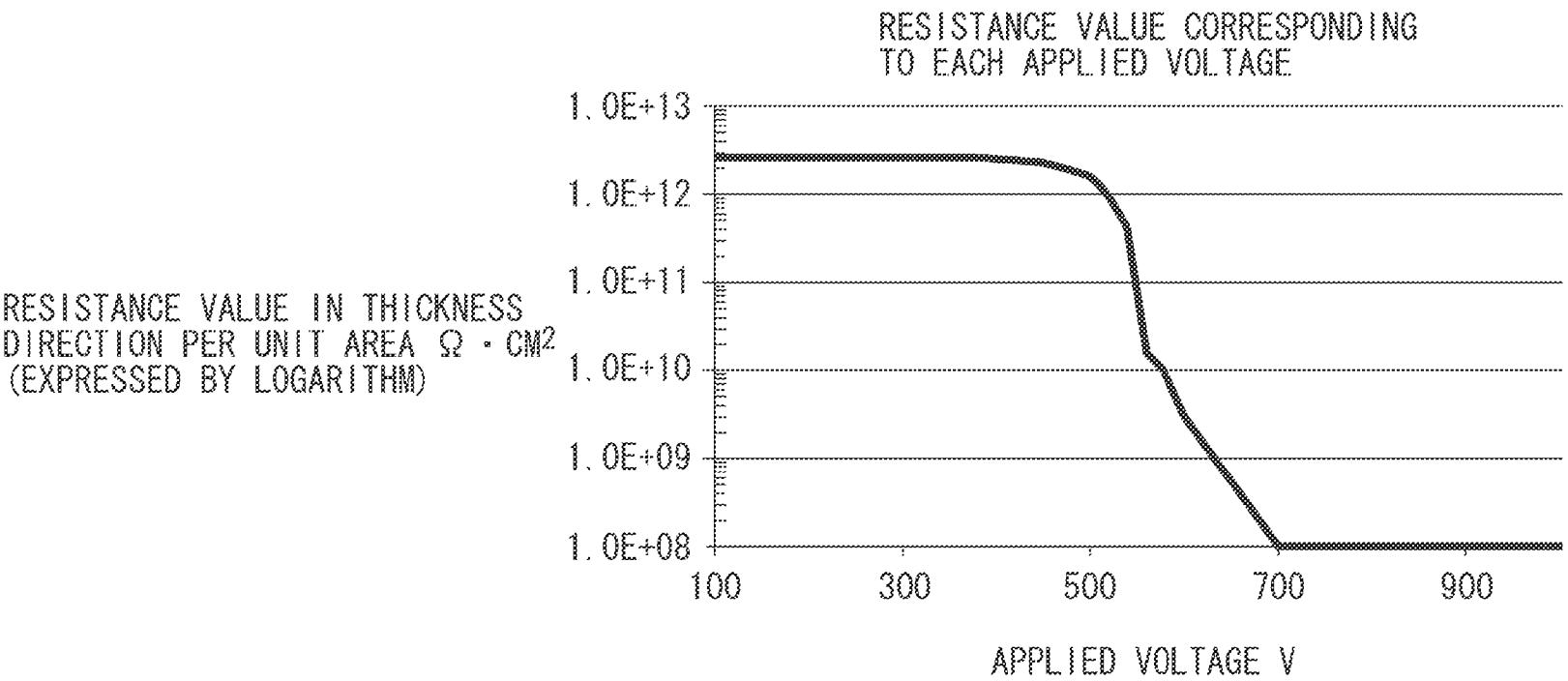
FIG. 2 is a graph illustrating a relationship between an applied voltage to a film and a resistance value of the film according to the first exemplary embodiment.

A property which the film 25 in the first exemplary embodiment has in order to balance the prevention of the overall offset with the prevention of the separating offset will be described. As illustrated in FIG. 2, the film 25 has the property that an electric resistance value ($\Omega \cdot cm^2$) in a thickness direction per unit area between the outer surface and the inner surface of the film 25 is dramatically reduced in the range of the potential of 550 V to 700 V on the film.

The property shown in FIG. 2 is obtained when the film 25 is at a temperature for enabling fixing (140° C.). The applied voltage that produces the potential at which the resistance value in the thickness direction is dramatically reduced is referred to as a breakdown voltage.

The film 25 in the first exemplary embodiment has the property that the resistance value per unit area between the outer surface and the inner surface of the film 25 is $5\times10^{11}$ ($\Omega \cdot cm^2$) or more and $5\times10^{9}$ ($\Omega \cdot cm^2$) or less when the voltage applied between the outer surface and the inner surface of the film 25 is in the range of 500 V or less and 1000 V or more, respectively.

In the first exemplary embodiment, the above 500 V indicates a maximum voltage between the outer surface and the inner surface of the film 25, which is applied to the film 25 for the countermeasure to the overall offset. The above 1000 V indicates a minimum voltage that causes an offset recognized as an image failure in practice among the voltages applied to the film by a separating discharge produced when the trailing edge of the recording material is separated from the film.

The lower limit of a resistance value measured by a measuring instrument used in the first exemplary embodiment is $1\times10^{8}$ $\Omega \cdot cm^2$. Thus, the resistance value expressed as $1\times10^{8}$ $\Omega \cdot cm^2$ in FIG. 2 is thought to be actually lower than the value.

Subsequently, a reason why the overall offset can be prevented by the above property of the film 25 will be described. As described above, the pure fluorine resin is used for the surface layer 263 of the pressure roller 26 in the first exemplary embodiment, and thus the surface layer 263 of the pressure roller 26 is charged with charge having the same polarity as that of the toner by the sliding friction with the recording material. Thus, the voltage is applied so that the potential on the surface of the film is −400 V as the countermeasure to the overall offset in the first exemplary embodiment. This forms the electric field between the surface of the film 25 and the surface of the pressure roller 26, and electrostatically presses toner T unfixed on the recording material P, to fix the toner T onto the recording material P, thereby preventing an occurrence of the overall offset.

However, when the resistance value per unit area between the outer surface and the inner surface of the film 25 is small, an effect of preventing the overall offset is reduced and inversely deteriorated in some cases. Because, when the voltage is applied, the current flows from the film 25 to the pressure roller 26, and the pressure roller 26 during paper passing or an interval of paper passing is also charged to a negative potential (the same polarity as that of the toner). Also since the current flows on the film, an absolute value of the surface potential of the film 25 is reduced. As a result, a force of the electric field that presses the unfixed toner T onto the recording material P at the nip portion N is weakened, or a force of the electric field in a direction that peels off the unfixed toner T from the recording material P occurs, which causes the overall offset.

Thus, when the voltage is applied so that the surface of the film 25 has the potential in the range of −500 V or less, if the resistance value per unit area between the outer surface and the inner surface of the film 25 is $5\times10^{11}$ ($\Omega \cdot cm^2$) or more, the current becomes difficult to flow between the outer surface and the inner surface of the film 25 and the overall offset does not occur. This is because the negative surface potential can be kept on the film 25 and the unfixed toner T can be pressed onto the recording material P by the force of the electric field at the nip portion N.

Figure 6:
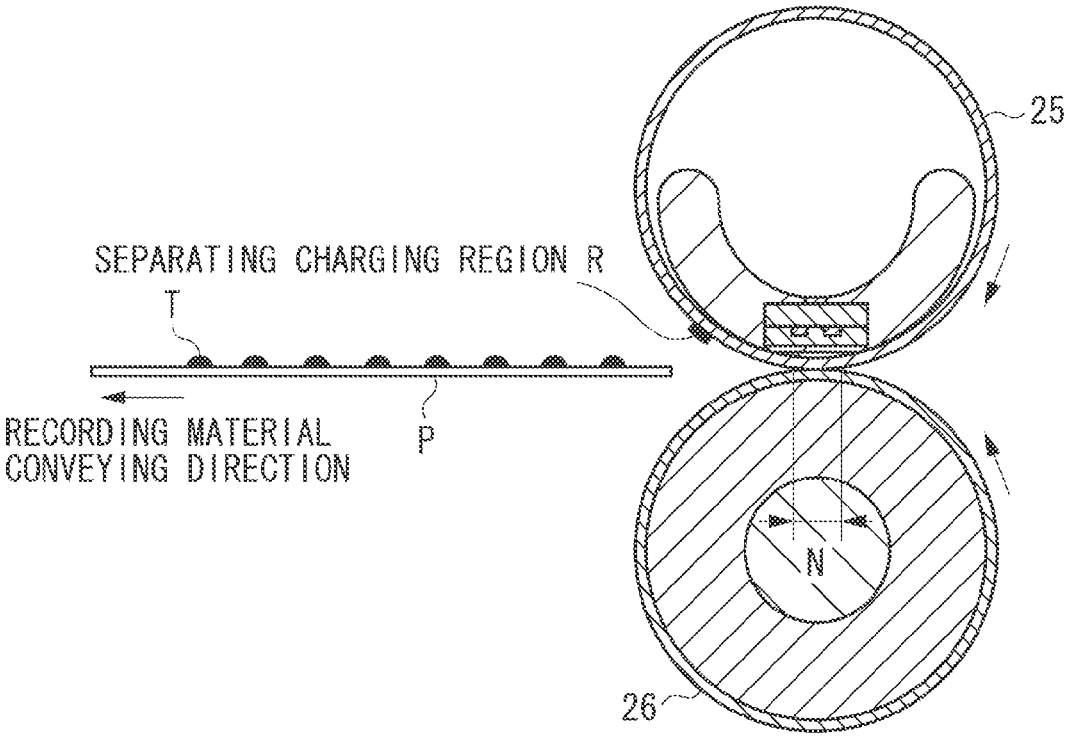
FIG. 6 is a cross-sectional image view illustrating a fixing apparatus in which a separating discharge occurs, according to the first exemplary embodiment.

A property of the film 25 required for preventing the separating offset will be described. FIG. 6 is a schematic image view illustrating an appearance of the separating discharge when the separating offset occurs. When the recording material P passes through the nip portion N and the trailing edge of the recording material P is separated from a surface layer 253 of the film 25, a discharge occurs if a potential difference between the recording material P and the film 25 exceeds a discharge threshold given by the Paschen curve. This discharge forms a region R charged with the separating discharge on the surface of the film 25. The region R is formed into stripe in a lengthwise direction of the film and its width is 0.1 mm to 2 mm.

This region R has the polarity reverse to that of the toner because the region R has the same polarity as that of the charge given to the recording material in order to attract the unfixed toner image T to the recording material. Here, the discharge may occur at various voltages because the potential difference that causes the discharge varies depending on the amount of a water vapor contained in air in an ambient environment, the charge of the trailing edge of the recording material, and the resistance value of the recording material. However, the separating offset that is practically problematic is likely to occur when the voltage between the outer surface and the inner surface of the region R is 1000 V or more.

The level of the separating offset varies depending on the attenuation rate of the charge charged on the film 25 due to the separating discharge. The smaller the resistance value ($\Omega \cdot cm^2$) between the outer surface and the inner surface of the film 25, the larger the attenuation rate. This is because the current becomes easy to flow in the thickness direction of the film 25, and thus the charge becomes easy to be removed.

In the first exemplary embodiment, in order to remove the charge charged on the surface of the film 25 due to the separating discharge while the film 25 turns around once, by passing the film in the thickness direction, it is necessary that the resistance value per unit area between the outer surface and the inner surface of the film 25 is to be $5\times10^{9}$ ($\Omega \cdot cm^2$) or less. The reason will be explained with calculations in the case where the voltage between the outer surface and the inner surface became 1000 V due to the separating discharge in the film 25 where the resistance value between the outer surface and the inner surface was $5\times10^{9}$ ($\Omega \cdot cm^2$).

A capacitance C per unit area of the film 25 is approximately $6\times10^{-11}$ ($F/cm^2$) depending on the type of a filler added to the elastic layer 252. Therefore, a separating charge Q, when the voltage of 1000 V is applied between the outer surface and the inner surface of the film 25 due to the separating discharge, is $Q=6\times10^{-8}$ ($Q/cm^2$). Meanwhile, the current I per unit time, which flows in the film 25, can be calculated as follows:

$$1=1000\ (V)/5\times10^{9}\ (\Omega \cdot cm^2)=2\times10^{-7}(A)$$

The film 25 in the first exemplary embodiment has a diameter of $\phi$30 mm, and thus, a time period taken for one rotation of the film is 0.27 seconds. Therefore, the current $\Delta Q$ that flows in the film 25, while the film 25 turns around once, can be calculated as follows:

$$\Delta Q=2\times10^{-7}(A)\times0.27\ (sec)=5.4\times10^{-8}(Q)$$

Thus, a rate at which the separating charge Q attenuates, while the film 25 turns around once, is calculated as follows:

$$\Delta Q/Q=5.4\times10^{-8}/6\times10^{-8}=0.9(90\%)$$

From the above, a majority (90%) of the charge due to the separating discharge on the surface of the film 25 attenuates, while the film turns around once.

When 90% of the charge due to the separating discharge on the film 25 attenuates, the potential on the surface of the film 25 becomes 100 V, which does not matter in practice.

Therefore, when the voltage between the outer surface and the inner surface of the region R, where the separating discharge occurs on the surface of the film 25, is in the range of 1000 V or more and the resistance value in the thickness direction of the film is $5\times10^9$ ($\Omega\cdot cm^2$) or less, the separating offset can be prevented.

Summarizing the points so far, in order to balance the prevention of the overall offset with the prevention of the separating offset, the film 25 only has to have the property as follows.

More specifically, the property is that the resistance value per unit area between the outer surface and the inner surface of the film 25 becomes $5\times10^{11}$ ($\Omega\cdot cm^2$) or more and $5\times10^9$ ($\Omega\cdot cm^2$) or less when the voltage applied between the outer surface and the inner surface of the film 25 is in the range of 500 V or less and in the range of 1000 V or more, respectively.

One example of the method in which the electric resistance value of the film 25 is measured will be described below. In the first exemplary embodiment, the resistance value was measured by a double ring method generally used when a volume resistance is measured. As a preparation for this measurement, a test piece of the film 25, the resistance value of which was measured, was made by cutting out into a 60 mm square plate and giving a metal vapor deposition in a shape shown in FIG. 3 (i.e., the portions of a and b in the figure) to a side of the surface layer 253. A purpose of performing this metal vapor deposition is to stably assure a contact area even in a high resistant material. In the first exemplary embodiment, stainless (SUS) is used for the base layer 251, and thus no metal vapor deposition is given to a side of the base layer 251.

Figure 4:
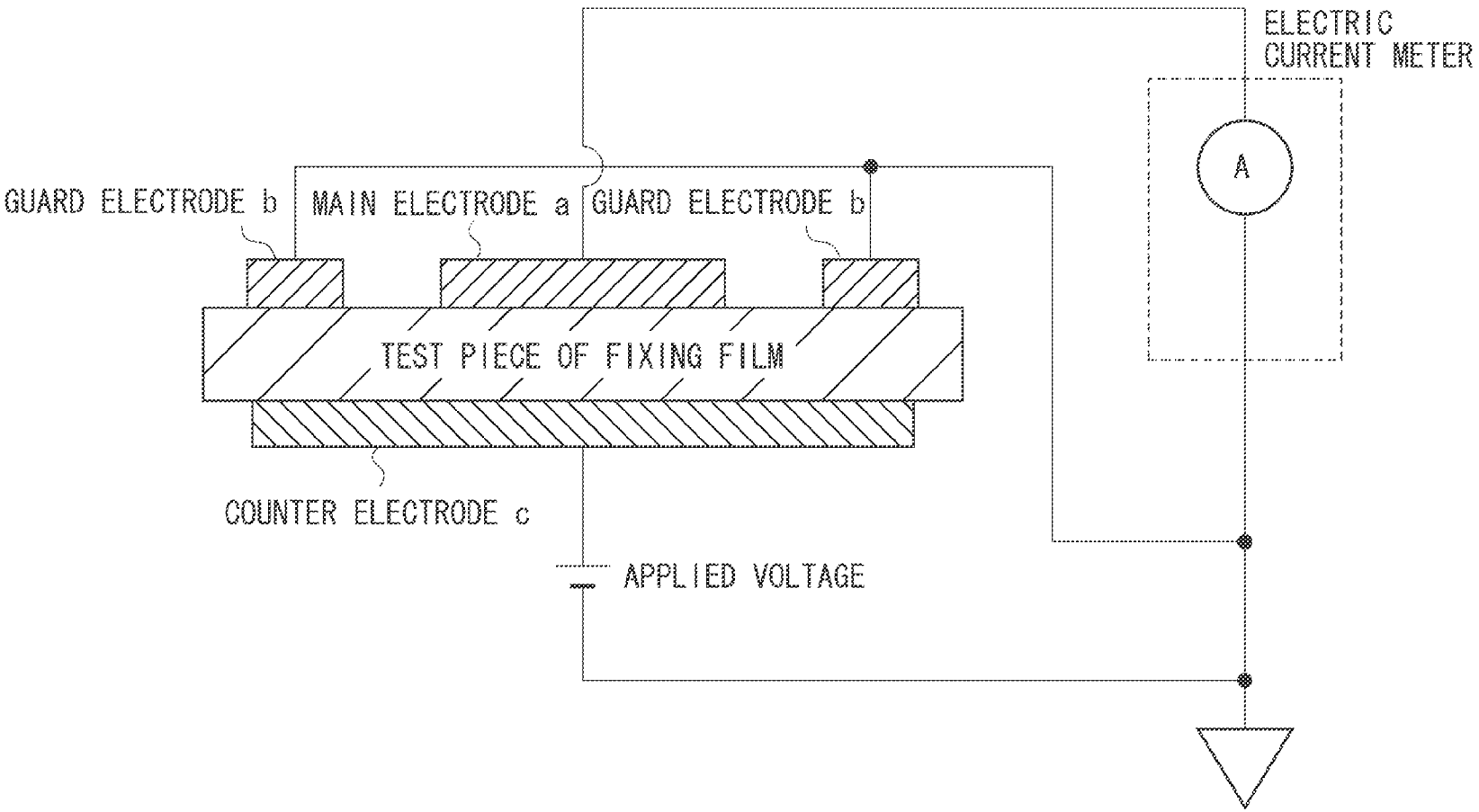
FIG. 4 is a schematic view illustrating a method of measuring the resistance value of the film according to the first exemplary embodiment.

A specific method of measuring a volume resistance value will be described. A method of measuring the resistance in the thickness direction of the film 25 used in the first exemplary embodiment is shown in FIG. 4. A high resistance measuring instrument "Model 6517A" manufactured by KEITHLEY was used as an electric current meter. This measurement was carried out by heating the test piece of the film to a temperature (140° C.) at which the film 25 is used for fixing. A major electrode a, a guard electrode b, and a counter electrode c were connected to an earth to remove the charge before measuring the resistance. The voltage ranging from 100 V to 1000 V was applied, then a current value was read 2 minutes after applying the voltage for stabilizing a measured value, and the resistance value R ($\Omega\cdot cm^2$) per unit area between the outer surface and the inner surface of the film at each voltage was calculated according to the following formula (I):

$$R = \rho \times t = \frac{V}{I} \times \frac{\pi r^2}{4} \quad (1)$$

Symbols used in the formula (I) are as follows: ρ (Ω cm): volume resistivity, t (cm): film thickness, I (A): measured current value, V (V): applied voltage value, and r (cm): diameter of major electrode (=2.5 cm). Here in the first exemplary embodiment, the resistance value R ($\Omega\cdot cm^2$) per unit area between the outer surface and the inner surface of the film is defined as a product of the volume resistivity p and the film thickness t as shown in the formula (I).

Figure 5:
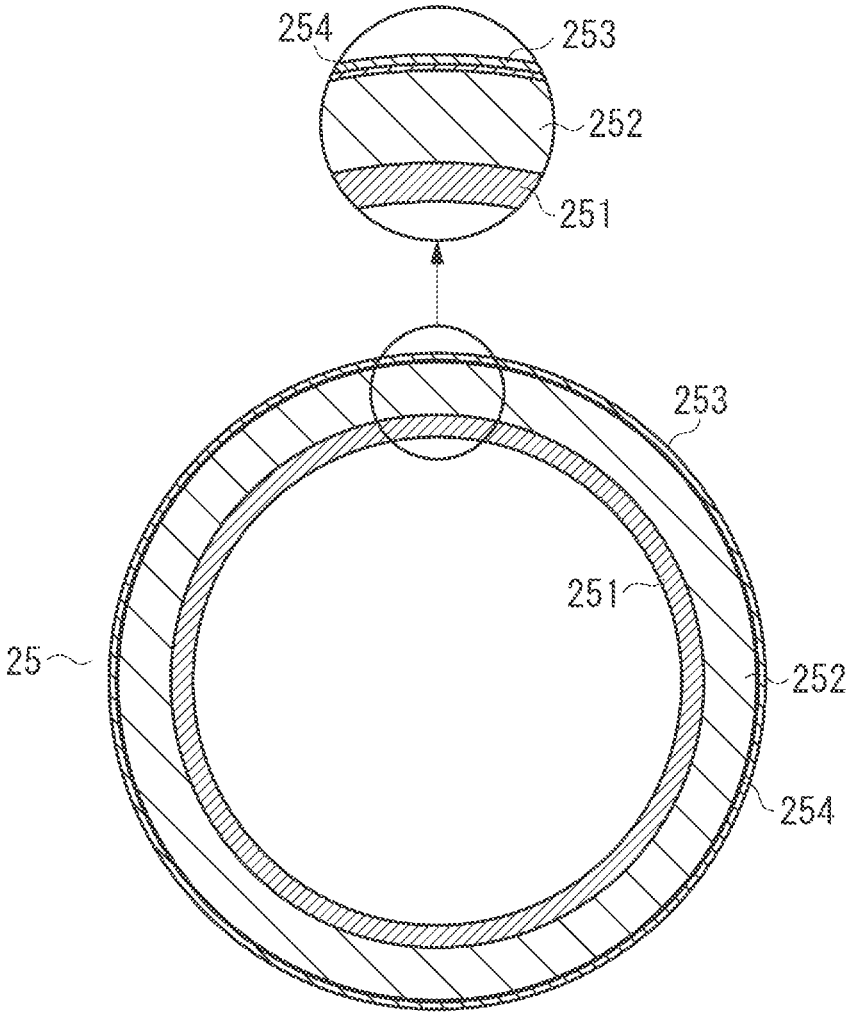
FIG. 5 is a cross-sectional view illustrating the film according to the first exemplary embodiment.

One example of a layer configuration of the film 25 having the resistance property as described above in the first exemplary embodiment will be shown. The layer configuration of the film 25 includes a multilayer provided with a base layer 251, an elastic layer 252, and a surface layer 253 from an inside as illustrated in FIG. 5.

A thin-walled metal material of stainless (SUS), nickel (Ni), or the like is used as a material for the base layer 251 for enhancing a thermal conductivity, an electric conductivity, and a durability. The base layer 251 desirably has a thickness of 15 μm or more and 50 μm or less because it is necessary to satisfy the quick start by reducing a thermal capacity as well as satisfy a mechanical strength. A tubular stainless (SUS) element tube having a thickness of 35 μm is used as the base layer 251 in the first exemplary embodiment. The elastic layer 252 is formed of a silicone rubber. The toner image T can be enclosed and the heat can be evenly given by providing this elastic layer 252. Thus, it becomes possible to obtain a fixed image with good quality having a high glossiness and no unevenness. A thermally conductive filler is added to the elastic layer 252 because the silicone rubber alone has the low thermal conductivity. It is desirable to assure about 1.2 W/mk as the thermal conductivity of the elastic layer 252.

Candidates of the thermally conductive filler in terms of thermal conductivity alone include alumina, metal silicon, silicon carbide, and zinc oxide. However, in order to satisfy the property that the resistance value per unit area between the outer surface and the inner surface of the film 25 is dramatically reduced in the range of the voltage of 550 V to 700 V applied to the film 25, it is necessary to select at least one of metal silicon, silicon carbide, and zinc oxide as the filler.

Figure 3:
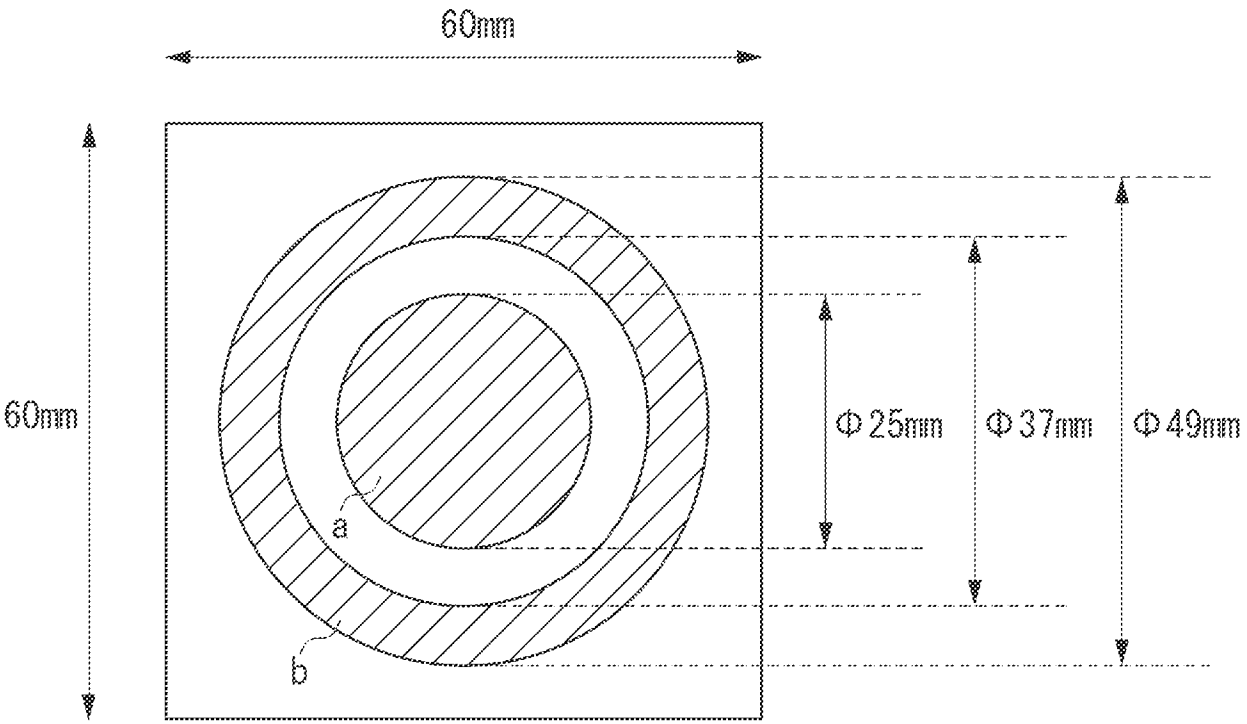
FIG. 3 is a schematic view illustrating a test piece for measuring the resistance value of the film according to the first exemplary embodiment.

Alumina has a large band gap value and easily becomes highly insulative. Only by adding a small amount of alumina to the rubber, the breakdown voltage becomes 1000 V or more. Thus, it is difficult that the use of alumina produces the resistance property as shown in FIG. 3.

For the aforementioned reason, in the first exemplary embodiment, the elastic layer 252 contains 400 parts by weight of metal silicon that is the thermally conductive filler based on 100 parts by weight of dimethylpolysiloxane that is the material of the rubber, and its thermal conductivity is to be 1.2 W/mk. A thickness of the elastic layer is to be 240 μm.

The surface layer 253 requires a high abrasion resistance as the release layer and a high mold release property against the toner. A fluorine resin such as a perfluoroalkoxy resin (PFA), polytetrafluoroethylene (PTFE), or a tetrafluoroethylene hexafluoropropylene resin (FEP) is used as the material. And, an ion conductive agent such as an organic phosphorous compound, antimony pentoxide, titanium oxide, and a lithium salt, and an electron conductive agent such as carbon black and carbon nano-fiber are added to this fluorine resin to adjust the resistance value. The thickness thereof is desirably about 10 μm to 50 μm. The surface layer may be covered with a tube or the surface thereof may be coated with paint. PFA is used as the fluorine resin for the surface layer 253 in the first exemplary embodiment. Hishicolin PX-2B (manufactured by Nippon Chemical Industrial Co., Ltd.) that is an organic phosphorous-based compound represented by $(C_2H_5)_4P\cdot BR$ in an amount of 7% by weight is mixed with the PFA. PFA is made to a coating layer having a thickness of 15 μm.

A primer layer 254 serves as an adhesion layer to bond the surface layer 253 to the elastic layer 252, and is formed of a fluorine resin primer of a fluorine resin or fluorinated silicone having a low melting point. An adhesive ingredient such as a silane coupling agent can also be contained in this primer layer 254 for enhancing an adhesion performance. The electron conductive agent such as carbon black, the ion conductive agent, and an antistatic agent can also be added. In the first exemplary embodiment, neither the conductive agent nor the antistatic agent was added to make an insulating fluorine resin layer, and the thickness thereof is 3 μm.

In order to explain a function effect of the fixing apparatus in the first exemplary embodiment, a comparative experiment using a fixing apparatus as a comparative example was carried out, and the results thereof are shown below. The film 25 in the first exemplary embodiment exhibits a voltage/resistance property as illustrated in FIG. 2.

Figure 7:
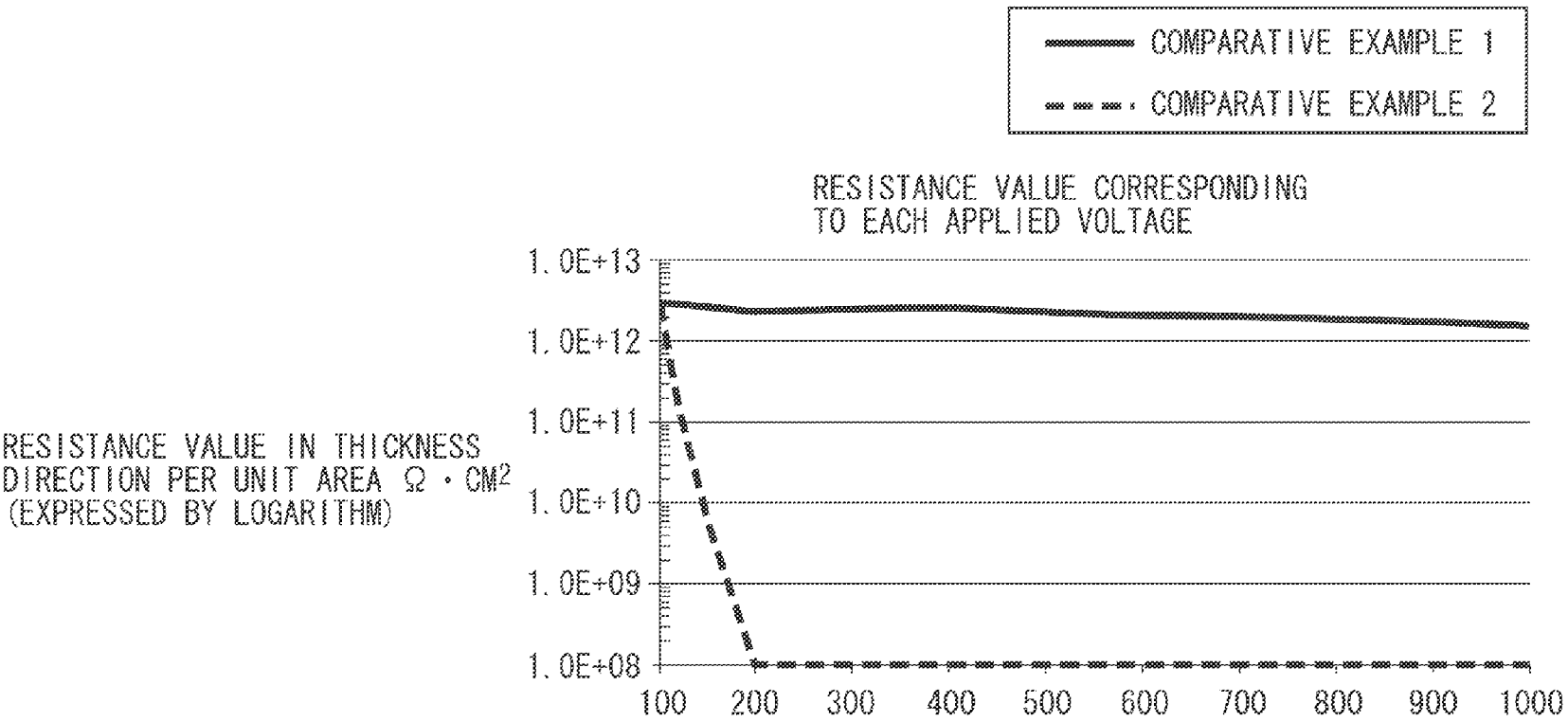
FIG. 7 is a graph illustrating a relationship between the applied voltage to the film and the resistance value of the film in comparative examples 1 and 2.

The first exemplary embodiment is different from comparative examples 1 and 2 only in configuration of the film 25 arranged in the fixing apparatus. Other configurations are the same, and thus the description thereof is omitted. FIG. 7 is a graph illustrating a relationship between the voltage applied between the outer surface and the inner surface of the film and the resistance value per unit area between the outer surface and the inner surface of the film for use in the fixing apparatus in the comparative examples 1 and 2. As illustrated in FIG. 7, the resistance value per unit area between the outer surface and the inner surface of the film in the comparative example 1 becomes $5\times10^{11}$ ($\Omega\cdot cm^2$) or more when the applied voltage is in the range of 100 V to 1000 V. Meanwhile, the resistance value per unit area between the outer surface and the inner surface of the film in the comparative example 2 becomes $5\times10^{11}$ ($\Omega\cdot cm^2$) or more when the applied voltage is in the range of 100 V or less, but reduces to $5\times10^{9}$ ($\Omega\cdot cm^2$) or less when the applied voltage is in the range of 200 V or more. The resistance value in the thickness direction per unit area was measured in the same manner as that in the first exemplary embodiment, and thus, the description on the measurement method is omitted.

The layer configuration of the film 25 in the comparative examples 1 and 2 will be described. The layer configurations of the film 25 in the first exemplary embodiment and comparative examples 1 and 2 are summarized in Table 1.

TABLE 1

Comparison of layer configurations in the first exemplary embodiment 1, and comparative examples 1 and 2

| | Base layer 251 | Elastic layer 252 | Primer layer 254 | Surface layer 253 |
|---|---|---|---|---|
| First exemplary embodiment | SUS | Metal silicon filler | Pure fluorine resin primer | PFA ion conductive agent |
| Comparative example 1 | SUS | Metal silicon filler | Pure fluorine resin primer | Pure PFA |
| Comparative example 2 | SUS | Metal silicon filler with carbon | fluorine resin primer with Carbon | PFA with Carbon |

The base layer 251 in comparative examples 1 and 2 is formed of the same stainless (SUS) as that in the first exemplary embodiment. The thickness and the thermal conductivity of the base layer 251, the elastic layer 252, and the surface layer 253 are the same as those in the first exemplary embodiment.

The elastic layer 252 and the primer layer 254 in Comparative Example 1 are the same as those in the first exemplary embodiment. The film in the comparative example 1 is different from the film in the first exemplary embodiment only in the surface layer 253. The surface layer 253 in the comparative example 1 includes a coating layer using pure PFA without adding the conductive agent.

The elastic layer 252 in the comparative example 2 contains, as the thermally conductive filler of the silicone rubber, the same metal silicon as that in the first exemplary embodiment, but further contains 10% by weight of carbon black as the conductive agent. The surface layer 253 in the comparative example 2 contains 5% by weight of carbon black as the conductive agent in addition to PFA. The primer layer in the comparative example 2 also contains 5% by weight of carbon black as the conductive agent.

A condition under which this validation was carried out will be set forth. In the fixing apparatus used in this validation, a pressure applied from the film to the pressure roller is 186.2 N (19 kgf), and a width of the nip portion is 9 mm. The test was carried out under a low temperature and low humidity environment (temperature: 10° C., humidity: 15%) where the separating offset and the overall offset are likely to occur. Paper of Neenah Bond (high resistant paper in letter size, with grammage of 60 g/m$^2$) was used for the evaluation. Under this condition, 100 sheets of the recording paper continuously passed the fixing apparatus in the first exemplary embodiment and the comparative example 1 and 2, and levels of the separating offset and the overall offset were evaluated on the 1st, 10th, 50th, and 100th sheets. At this time, a surface potential on the pressure roller 26, while the paper passed the fixing apparatus, was also measured using a surface potential meter "Model 370" manufactured by TREK.

The levels of the separating offset and the overall offset on each sheet of paper and the surface potential on the pressure roller in the fixing apparatus in the first exemplary embodiment, comparative example 1 and 2 are shown in Table 2. Symbols in Table 2, which represent the levels of the separating offset and the overall offset are as follows: A indicates good fixing, without separating offset and overall offset, B indicates no practical problems, with acceptable levels of separating offset and overall offset, and C indicates practical problems, with unacceptable levels of separating offset and overall offset.

TABLE 2

Comparison of evaluation results of offsets in the first exemplary embodiment, comparative examples 1 and 2

| | Development | 1st sheet | 10th sheet | 50th sheet | 100th sheet |
|---|---|---|---|---|---|
| First exemplary embodiment | Separating offset | A | A | A | A |
| | Overall offset | A | A | A | A |
| | Pressure roller potential | 0 V | −50 V | −80 V | −100 V |
| Comparative Example 1 | Separating offset | A | C | C | C |
| | Overall offset | A | A | A | A |
| | Pressure roller potential | 0 V | −70 V | −90 V | −100 V |
| Comparative Example 2 | Separating offset | A | A | A | A |
| | Overall offset | A | B | C | C |
| | Pressure roller potential | 0 V | −300 V | −800 V | −1000 V |

According to the results in Table 2, in the fixing apparatus using the film in the first exemplary embodiment, neither the separating offset nor the overall offset occurred throughout the 100 sheets of the paper, and the level of fixing was good. The surface potential on the pressure roller 26 was −100 V after the 100 sheets of the paper passed, and no remarkable charge was observed.

This is because the film 25 in the first exemplary embodiment has the resistance property as illustrated in FIG. 2. More specifically, in the film 25 in the first exemplary embodiment, when the voltage of 1000 V or more, which is a practically problematic voltage level to cause the separating offset, is applied between the outer surface and the inner surface of the film 25, the resistance value per unit area between the outer surface and the inner surface of the film 25 becomes $5\times10^9$ ($\Omega\cdot cm^2$) or less. As a result, the charge due to the separating discharge on the surface of the film 25 attenuates to a practically problem-free level while the film turns around once, and thus no separating offset occurs. Also in the film 25 in the first exemplary embodiment, when the voltage of 500 V or less is applied between the outer surface and the inner surface of the film 25, the resistance value per unit area between the outer surface and the inner surface of the film 25 becomes $5\times10^1$ ($\Omega\cdot cm^2$) or more. As a result, the current becomes difficult to flow in the film 25 when the voltage is applied, and the surface potential on the pressure roller 26 is kept. Thus, no overall offset occurs.

On the other hand, the separating offset or the overall offset occurred and was practically problematic when the fixing apparatus in the comparative examples 1 and 2 was used.

In the fixing apparatus in the comparative example 1, the separating offset did not occur on just the first sheet with no precedent sheet, but the separating offset occurred on and after the 10th sheets at a practically problematic level. This is because in the film in the comparative example 1, when the voltage of 1000 V, which is the voltage applied to the film due to the separating discharge that is practically problematic, is applied, the resistance value in the thickness direction per unit area becomes $5\times10^{11}$ ($\Omega\cdot cm^2$) or more that is high. As a result, the charge due to the separating discharge scarcely attenuates even when the film turns around once, and the region R of the separating discharge adsorbs the toner in a subsequent round of the film to cause the separating offset.

Meanwhile, in the fixing apparatus in the comparative example 2, the overall offset did not occur on the first sheet because the pressure roller was not negatively charged, but the pressure roller was negatively charged (the same polarity as that of the toner) as the number of the passed sheets is increased. Thus, the overall offset slightly occurred on the 10th sheet, and the overall offset at a practically problematic level occurred on the 50th sheet. This is because in the film in the comparative example 2, when the voltage of 400 V as an absolute value is applied, the resistance value in the thickness direction per unit area is $5\times10^9$ ($\Omega\cdot cm^2$) or less that is low. As a result, the current flows on the pressure roller 26 via the film 25 during sheet passing and an interval of sheet passing, thereby the pressure roller is negatively charged and the force that presses the toner onto the recording material weakens to cause the overall offset.

As described above, when the film in the first exemplary embodiment is used, the function effect that the prevention of the overall offset can be balanced with the prevention of the separating offset, which cannot be achieved in the comparative examples 1 and 2.

The breakdown voltage in the film 25 is not necessary to be the same as that in the first exemplary embodiment. The breakdown voltage only has to be determined so that the resistance value in the thickness direction of the film becomes $5\times10^{11}$ ($\Omega\cdot cm^2$) or more and $5\times10^9$ ($\Omega\cdot cm^2$) or less when the voltage applied between the outer surface and the inner surface of the film 25 is in the range of 500 V or less and 1000 V or more, respectively. To that end, it is effective way to increase or decrease the amount of the ion conductive agent to be added to the surface layer 253 of the film 25 or to increase or decrease a net weight of the metal silicon filler to be added to the elastic layer. The breakdown voltage can also be changed by increasing or decreasing the thickness of the elastic layer.

The first exemplary embodiment is also applicable even in the film having no primer layer because the resistance value only has to be adjusted by containing the ion conductive agent and the electron conductive agent in the surface layer 253.

In the first exemplary embodiment, metal silicon alone is used as the thermally conductive filler to be contained in the elastic layer 252 in the film 25. However, either silicon carbide or zinc oxide, or one obtained by mixing metal silicon, silicon carbide and zinc oxide may be used as the thermally conductive filler to be contained in the elastic layer 252.

The configuration of a second exemplary embodiment of the present invention will be described. The fixing apparatus in the second exemplary embodiment is different from the fixing apparatus in the first exemplary embodiment only in configuration of the film 25. Thus, the description on the same configuration as that in the first exemplary embodiment is omitted.

The film in the second exemplary embodiment is different from the film in the first exemplary embodiment in that the surface layer 253 is formed of pure PFA with high resistance and in that the ion conductive agent is added to the primer layer 254 between the surface layer 253 and the elastic layer 252. The configuration of the film in the second exemplary embodiment is shown in Table 3.

TABLE 3

Layer configuration in the second exemplary embodiment

| | Base layer 251 | Elastic layer 252 | Primer layer 254 | Surface layer 253 |
|---|---|---|---|---|
| Second exemplary embodiment | SUS | Metal silicon filler | Fluorine resin primer with ion conductive agent | Pure PFA |

As shown in Table 3, the base layer 251 and the elastic layer 252 of the film in the second exemplary embodiment are the same as those in the first exemplary embodiment. The pure PFA having a thickness of 15 μm is used for the surface layer 253. The primer layer 254 is formed of a fluorine resin layer having a thickness of 3 μm, and the ion conductive agent was added to adjust the resistance value. Carbon, a lithium salt, an organic phosphorous compound, a boron compound salt, and the like can be used as the ion conductive agent. As the lithium salt, $LiBF_4$, $LiClO_4$, $LiPF_6$, $LiAsF_6$, $LiSbF_6$, $LiSO_3CF_3$, $LiN(SO_2CF_3)_2$, $LiSO_3C_4F_9$, $LiC(SO_2CF_3)_3$, $LiB(C_6H_5)_4$, or the like are used. $LiC(SO_2CF_3)_3$ is used as the lithium salt in the second exemplary embodiment.

Figure 8:
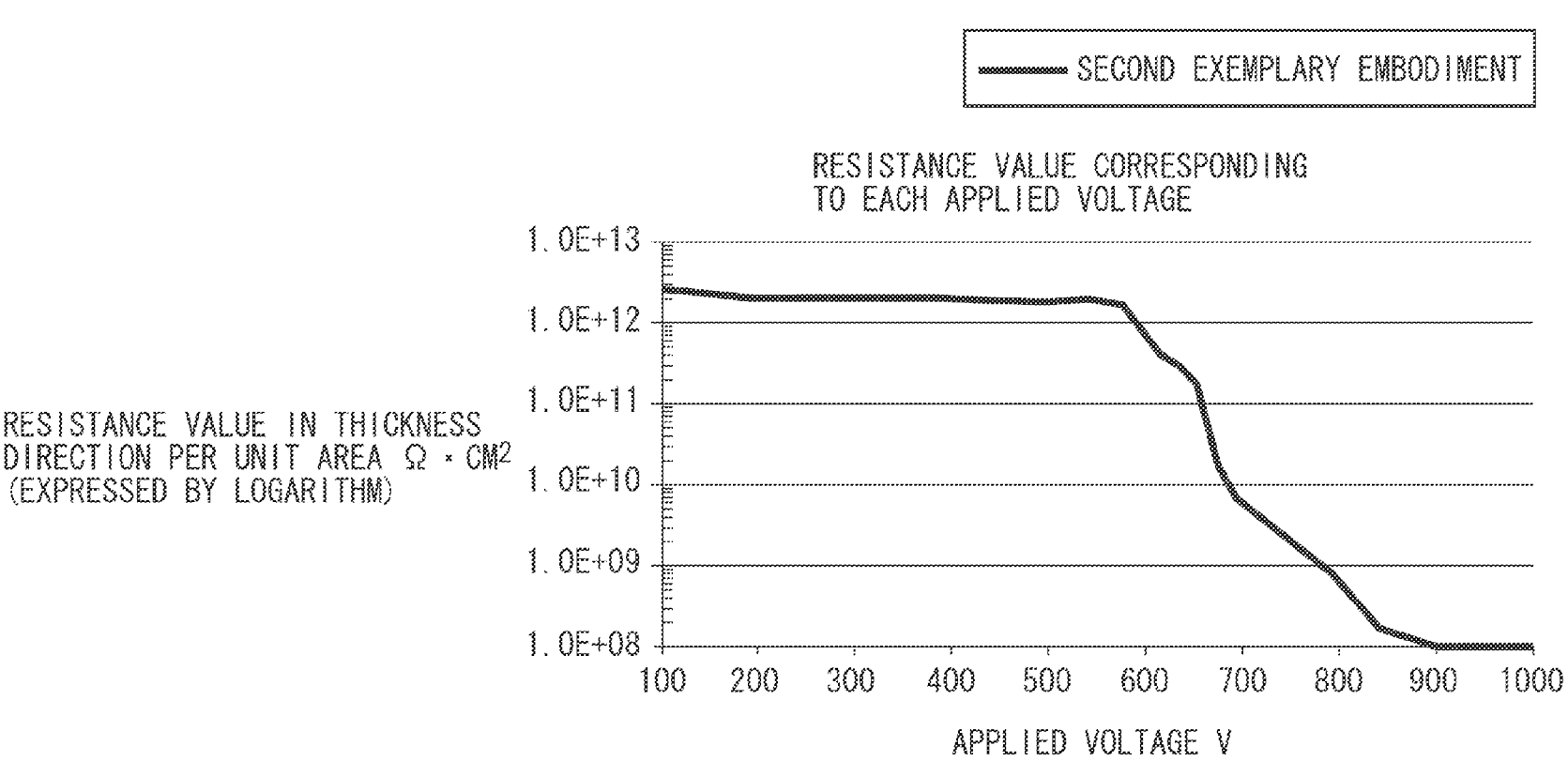
FIG. 8 is a graph illustrating a relationship between the applied voltage to the film and the resistance value of the film according to a second exemplary embodiment of the present invention.

An electric property of the film 25 in the second exemplary embodiment will be described. FIG. 8 is a graph illustrating a relationship between the voltage applied between the outer surface and the inner surface of the film 25 and the resistance value ($\Omega\cdot cm^2$) in the thickness direction per unit area at a fixing temperature (140° C.) of the film 25 in the second exemplary embodiment.

As shown in FIG. 8, in the resistance value in the thickness direction of the film 25, the breakdown voltage is observed in the range of 600 V to 800 V. As a result, the resistance value in the thickness direction of the film 25 becomes $5\times10^{11}$ ($\Omega\cdot cm^2$) or more at 500 V or less and $5\times10^9$ ($\Omega\cdot cm^2$) or less at 1000 V or more.

When the film 25 having such an electric property is used, the same function effect as that in the first exemplary embodiment can be obtained. More specifically, the prevention of the separating offset can be balanced with the prevention of the overall offset.

In the second exemplary embodiment, the lithium salt is used as the ion conductive agent contained in the primer layer in the film 25, but the electron conductive agent such as carbon and the other ion conductive agent such as an organic phosphorous compound can also be used. In addition, the breakdown voltage can be changed by increasing or decreasing the net weight of the filler to be added to the primer layer 254 in the same manner as that in the first exemplary embodiment.

The configuration of a third exemplary embodiment of the present invention will be described. The fixing apparatus in the third exemplary embodiment is different from the fixing apparatus in the first exemplary embodiment only in configuration of the film 25. Thus, the description on the same configuration as that in the first exemplary embodiment is omitted.

The film in the third exemplary embodiment is different from the film in the second exemplary embodiment in that the thermally conductive filler contained in the elastic layer 252 is formed of silicon carbide and in that both PFA as the surface layer 253 and the fluorine resin as the primer layer contain the filler having the electric conductivity. The layer configuration in the third exemplary embodiment is shown in Table 4.

TABLE 4

Layer configuration in the third exemplary embodiment

| | Base layer 251 | Elastic layer 252 | Primer layer 254 | Surface layer 253 |
|---|---|---|---|---|
| Third exemplary embodiment | SUS | Silicon carbide filler | Fluorine resin primer with ion conductive agent | PFA with ion conductive agent |

According to Table 4, the base layer 251 of the film in the third exemplary embodiment is formed of stainless (SUS) having a thickness of 35 μm as with the first exemplary embodiment. The elastic layer 252 contains 300 parts by weight of silicon carbide as the thermally conductive filler based on 100 parts by weight of the silicone rubber, the thermal conductivity thereof is 1.5 W/mk, and the thickness thereof is 240 μm. The surface layer 253 and the primer layer 254 contains the lithium salt, $LiC(SO_2CF_3)_3$ as the ion conductive agent.

By the use of the film having the layer configuration as shown in FIG. 4, the same function effect as that in the first and second exemplary embodiments can be obtained. More specifically, the prevention of the separating offset can be balanced with the prevention of the overall offset.

In The third exemplary embodiment, the thermally conductive filler contained in the elastic layer 252 in the film 25 is silicon carbide, but is not limited thereto. Metal silicon and zinc oxide may be used alone, or metal silicon, silicone carbide and zinc oxide may be used in mixture as the thermally conductive filler contained in the elastic layer 252 in the film 25. Also, the breakdown voltage can be shifted by changing a type or a mixed ratio of the thermally conductive filler contained in the elastic layer 252 in the same manner as that in the first and second exemplary embodiments.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-280103 filed Dec. 21, 2011, which is hereby incorporated by reference herein in its entirety.

What is claimed is:

1. A fixing apparatus for fixing a toner image on a recording material, while conveying the recording material bearing the toner image, at a nip portion, the fixing apparatus comprising:
- a tubular film including a rubber layer;
- a heater configured to heat the film; and
- a pressure member configured to form the nip portion with the film,
- wherein the film has a property that a resistance value per unit area between an outer surface of the film and an inner surface of the film becomes $5\times10^{11}$ ($\Omega\cdot cm^2$) or more when a voltage of 500 V or less is applied between the outer surface and the inner surface, and a resistance value per unit area between the outer surface and the inner surface becomes $5\times10^{9}$ ($\Omega\cdot cm^2$) or less when a voltage of 1000 V or more is applied between the outer surface and the inner surface.

2. The fixing apparatus according to claim 1, wherein the film comprises:
- a base layer formed of a metal; and
- a release layer formed of a fluorine resin containing a filler having an electric conductivity,
- wherein the rubber layer contains a filler that is at least one of metal silicon, silicon carbide, and zinc oxide.

3. The fixing apparatus according to claim 1, wherein the film comprises:
- a base layer formed of a metal;
- a release layer formed of a fluorine resin; and
- an adhesion layer formed of a fluorine resin containing an adhesive ingredient and configured to bond the release layer to the rubber layer,
- wherein a filler having an electric conductivity is contained in at least one of the release layer and the adhesion layer,
- wherein the rubber layer contains a filler that is at least one of metal silicon, silicon carbide, and zinc oxide.

4. The fixing apparatus according to claim 1, wherein the heater is in contact with the inner surface of the film and forms the nip portion with the pressure member via the film.

5. A film for use in a fixing apparatus fixing a toner image on a recording material, the film comprising: a rubber layer,
- wherein the film has a property that a resistance value per unit area between an outer surface of the film and an inner surface of the film becomes $5\times10^{11}$ ($\Omega\cdot cm^2$) or more when a voltage of 500 V or less is applied between the outer surface and the inner surface, and a resistance value per unit area between the outer surface and the inner surface becomes $5\times10^{9}$ ($\Omega\cdot cm^2$) or less when the voltage of 1000 V or more is applied between the outer surface and the inner surface.

6. The film according to claim 5, comprising:
- a base layer formed of a metal; and
- a release layer formed of a fluorine resin containing a filler having an electric conductivity,
- wherein the rubber layer contains a filler that is at least one of metal silicon, silicon carbide, and zinc oxide.

7. The film according to claim 5, comprising:
- a base layer formed from a metal;
- a release layer formed of a fluorine resin; and
- an adhesion layer formed of a fluorine resin containing an adhesive ingredient and configured to bond the release layer to the rubber layer,
- wherein the rubber layer contains a filler that is at least one of metal silicon, silicon carbide, and zinc oxide, and wherein a filler having an electric conductivity is contained in at least one of the release layer and the adhesion layer.

8. A film for use in a fixing apparatus fixing a toner image on a recording material, the film comprising:

a base layer formed from a metal;

a rubber layer, a material of which contains a filler that is at least one of metal silicon, silicon carbide, and zinc oxide; and a release layer formed from a fluorine resin containing a filler having an electric conductivity.

9. A film for use in a fixing apparatus fixing a toner image on a recording material, the film comprising:

a base layer formed of a metal;

a rubber layer, a material of which contains a filler that is at least one of metal silicon, silicon carbide, and zinc oxide;

a release layer formed of a fluorine resin; and an adhesion layer formed of a fluorine resin containing an adhesive ingredient and configured to bond the release layer to the rubber layer, wherein a filler having an electric conductivity is contained in at least one of the release layer and the adhesion layer.

10. The fixing apparatus according to claim 2, wherein the filler in the release layer is an ion conductive agent.

11. The film according to claim 8, wherein the filler in the release layer is an ion conductive agent.

12. The fixing apparatus according to claim 3, wherein the adhesion layer contains the filler, and wherein the filler in the adhesion layer is an ion conductive agent.

13. The film according to claim 9, wherein the adhesion layer contains the filler, and wherein the filler in the adhesion layer is an ion conductive agent.

14. The fixing apparatus according to claim 10, wherein the ion conductive agent is at least one of an organic phosphorous compound, antimony pentoxide, titanium oxide, and a lithium salt.

15. The film according to claim 11, wherein the ion conductive agent is at least one of an organic phosphorous compound, antimony pentoxide, titanium oxide, and a lithium salt.

16. The fixing apparatus according to claim 12, wherein the ion conductive agent is at least one of carbon, a lithium salt, an organic phosphorous compound, and a boron compound salt.

17. The film according to claim 13, wherein the ion conductive agent is at least one of carbon, a lithium salt, an organic phosphorous compound, and a boron compound salt.

18. The fixing apparatus according to claim 2, wherein the base layer is formed of stainless or nickel.

19. The fixing apparatus according to claim 3, wherein the base layer is formed of stainless or nickel.

20. The film according to claim 8, wherein the base layer is formed of stainless or nickel.

21. The film according to claim 9, wherein the base layer is formed of stainless or nickel.

22. A fixing apparatus for fixing a toner image on a recording material, while conveying the recording material bearing the toner image, at a nip portion, the fixing apparatus comprising:

a tubular film;

a heater configured to heat the film; and a pressure member configured to form the nip portion with the film, wherein the film comprises a base layer formed of stainless or nickel, a rubber layer containing a filler which is at least one of metal silicon, silicon carbide, and zinc oxide, and a release layer formed of a fluorine resin containing a filler which is an ion conductive agent.

23. A fixing apparatus for fixing a toner image on a recording material, while conveying the recording material bearing the toner image, at a nip portion, the fixing apparatus comprising:

a tubular film;

a heater configured to heat the film; and a pressure member configured to form the nip portion with the film, wherein the film comprises a base layer formed of stainless or nickel, a rubber layer containing a filler which is at least one of metal silicon, silicon carbide, and zinc oxide, a release layer formed of a fluorine resin, and an adhesion layer configured to bond the release layer to the rubber layer, and wherein the adhesion layer is formed of a fluorine resin containing a filler, which is an ion conductive agent, and an adhesive ingredient.

24. The fixing apparatus according to claim 22, wherein the ion conductive agent is at least one of an organic phosphorous compound, antimony pentoxide, titanium oxide, and a lithium salt.

25. The fixing apparatus according to claim 23, wherein the ion conductive agent is at least one of a carbon, a lithium salt, an organic phosphorous compound, and a boron compound salt.

26. A film for use in a fixing apparatus fixing a toner image on a recording material, the film comprising:

a base layer;

a rubber layer, a material of which contains a filler that is at least one of metal silicon, silicon carbide, and zinc oxide; and a release layer formed from a fluorine resin containing a filler having an electric conductivity.

27. The film according to claim 26, wherein the filler in the release layer is an ion conductive agent.

28. The film according to claim 27, wherein the ion conductive agent is at least one of carbon, a lithium salt, an organic phosphorous compound, and a boron compound salt.

29. A film for use in a fixing apparatus fixing a toner image on a recording material, the film comprising:

a base layer;

a rubber layer, a material of which contains a filler that is at least one of metal silicon, silicon carbide, and zinc oxide;

a release layer formed of a fluorine resin; and an adhesion layer formed of a fluorine resin containing an adhesive ingredient and configured to bond the release layer to the rubber layer, wherein a filler having an electric conductivity is contained in at least one of the release layer and the adhesion layer.

30. The film according to claim 29, wherein the adhesion layer contains the filler, and wherein the filler in the adhesion layer is an ion conductive agent.

31. The film according to claim 30, wherein the ion conductive agent is at least one of carbon, a lithium salt, an organic phosphorous compound, and a boron compound salt.

32. A fixing apparatus for fixing a toner image on a recording material, while conveying the recording material bearing the toner image, at a nip portion, the fixing apparatus comprising:

a tubular film;

a heater configured to heat the film; and a pressure member configured to form the nip portion with the film, wherein the film comprises a base layer, a rubber layer containing a filler which is at least one of metal silicon, silicon carbide, and zinc oxide, and a release layer formed of a fluorine resin containing a filler having an electric conductivity.

33. The fixing apparatus according to claim 32, wherein the filler in the release layer is an ion conductive agent.

34. The fixing apparatus according to claim 33, wherein the ion conductive agent is at least one of an organic phosphorous compound, antimony pentoxide, titanium oxide, and a lithium salt.

35. A fixing apparatus for fixing a toner image on a recording material, while conveying the recording material bearing the toner image, at a nip portion, the fixing apparatus comprising:

a tubular film;

a heater configured to heat the film; and a pressure member configured to form the nip portion with the film, wherein the film comprises a base layer, a rubber layer containing a filler which is at least one of metal silicon, silicon carbide, and zinc oxide, a release layer formed of a fluorine resin, and an adhesion layer configured to bond the release layer to the rubber layer, and wherein the adhesion layer is formed of a fluorine resin containing a filler, which has an electric conductivity, and an adhesive ingredient.

36. The fixing apparatus according to claim 35, wherein the filler in the release layer is an ion conductive agent.

37. The fixing apparatus according to claim 36, wherein the ion conductive agent is at least one of a carbon, a lithium salt, an organic phosphorous compound, and a boron compound salt.

* * * * *